US006936137B2

(12) United States Patent
Moeller et al.

(10) Patent No.: US 6,936,137 B2
(45) Date of Patent: Aug. 30, 2005

(54) AIR CLAMP STABILIZER FOR CONTINUOUS WEB MATERIALS

(75) Inventors: Stefan Moeller, San Jose, CA (US); Steven Axelrod, Los Altos, CA (US); Jenson Luis, San Jose, CA (US)

(73) Assignee: Honeywell International Inc., Morristown, NJ (US)

( * ) Notice: Subject to any disclaimer, the term of this patent is extended or adjusted under 35 U.S.C. 154(b) by 353 days.

(21) Appl. No.: 10/263,253

(22) Filed: Oct. 2, 2002

(65) Prior Publication Data

US 2003/0075293 A1 Apr. 24, 2003

Related U.S. Application Data

(60) Provisional application No. 60/345,860, filed on Oct. 24, 2001.

(51) Int. Cl.[7] ..... D21F 1/36; D21F 1/42; B65H 20/14

(52) U.S. Cl. ..... 162/193; 162/289; 226/7; 226/97.3; 242/615.11; 406/88; 406/197

(58) Field of Search ..... 162/193, 194, 162/199, 207, 272, 286, 289; 226/7, 91, 97.3; 242/615.11; 34/461, 641; 271/195; 406/88, 86, 197

(56) References Cited

U.S. PATENT DOCUMENTS

| | | | | |
|---|---|---|---|---|
| 3,549,070 | A | * 12/1970 | Frost et al. | 242/615.11 |
| 3,763,571 | A | * 10/1973 | Vits | 34/641 |
| 3,988,973 | A | 11/1976 | Hönmann | |
| 4,074,841 | A | * 2/1978 | Kramer et al. | 226/97.3 |
| 4,257,756 | A | 3/1981 | Gasson | |
| 4,278,624 | A | 7/1981 | Kornylak | |
| 4,606,137 | A | 8/1986 | Whipple | |
| 4,767,935 | A | 8/1988 | Anderson et al. | |
| 4,879,471 | A | 11/1989 | Dahlquist | |
| 4,932,140 | A | 6/1990 | Lepisto | |
| 5,370,289 | A | * 12/1994 | Helms | 242/615.11 |
| 5,471,766 | A | * 12/1995 | Heikkila et al. | 34/461 |
| 5,490,300 | A | 2/1996 | Horn | |
| 5,606,805 | A | * 3/1997 | Meyer | 34/421 |
| 5,738,760 | A | * 4/1998 | Svanqvist et al. | 162/193 |
| 5,853,543 | A | 12/1998 | Hu et al. | |
| 5,884,360 | A | 3/1999 | Palffy | |
| 5,891,306 | A | 4/1999 | Chase et al. | |
| 5,891,309 | A | 4/1999 | Page et al. | |
| 5,991,964 | A | 11/1999 | Baum | |
| 6,039,269 | A | 3/2000 | Mandzukic | |
| 6,080,278 | A | 6/2000 | Heaven et al. | |
| 6,191,430 | B1 | 2/2001 | Belotserkovsky et al. | |
| 6,193,810 | B1 | 2/2001 | Baum | |
| 6,281,679 | B1 | 8/2001 | King et al. | |
| 6,338,814 | B1 | 1/2002 | Hills | |
| 6,357,464 | B2 | 3/2002 | Babenko | |
| 2002/0092637 | A1 | * 7/2002 | Rouhiainen et al. | 162/272 |

FOREIGN PATENT DOCUMENTS

EP 0 298 299 A1 1/1989

OTHER PUBLICATIONS

International Search Report, dated Mar. 6, 2003, relative to PCT application No. PCT/US 02/33674, the foreign equivalent to the instant U.S. Appl. No. 10/263,253.

* cited by examiner

*Primary Examiner*—Eric Hug
(74) *Attorney, Agent, or Firm*—Fliesler, Meier L.L.P.; Anthony Miologos

(57) ABSTRACT

A device for non-contact support of a continuous moving web of material employs an air clamp stabilizer that includes a Coanda slot and a backstep that is located downstream of the direction of the airflow extending from the Coanda slot. This configuration permits a Coanda jet to expand and to create an additional suction force. Vortex formation may also occur which further contributes to the strength of the suction force. As the web passes the stabilizer, an area of the web material rides on an air bearing that is maintained above the stabilizer surface and downstream of the backstep.

22 Claims, 7 Drawing Sheets

AIR CLAMP STABILIZER FOR CONTINUOUS WEB MATERIALS

REFERENCE TO RELATED APPLICATION

This application claims priority to U.S. Provisional Application Ser. No. 60/345,860 filed on Oct. 24, 2001.

FIELD OF THE INVENTION

The present invention relates to an air stabilizer apparatus for non-contact support of a moving, continuous web of material. The air stabilizer imparts a force on the continuous web thereby maintaining the web material in a relatively flat profile as the web passes over the air stabilizer. This permits accurate measurements of web properties at the flat profile. The apparatus is particularly suited for use in the manufacture and processing of paper products.

BACKGROUND OF THE INVENTION

In the art of making paper with modern high-speed machines, sheet properties must be continually monitored and controlled to assure sheet quality and to minimize the amount of finished product that is rejected. The sheet variables that are most often measured include basis weight, moisture content, and caliper, i.e., thickness, of the sheets at various stages in the manufacturing process. These process variables are typically controlled by adjusting the feedstock supply rate at the beginning of the process, regulating the amount of steam applied to the paper near the middle of the process, and/or varying the nip pressure between calendaring rollers at the end of the process. Papermaking devices are well known in the art and are described, for example, in "Handbook for Pulp & Paper Technologists" 2nd ed., G. A. Smook, 1992, Angus Wilde Publications, Inc. Sheetmaking systems are further described, for example, in U.S. Pat. No. 5,853,543 "Method for Monitoring and Controlling Water content in Paper Stock in a Paper Making Machine," U.S. Pat. No. 5,891,306 "Electromagnetic Field Perturbation Sensor and Methods for Measuring Water Contents in Sheetmaking Systems," and U.S. Pat. No. 6,080,278 "Fast CD and MD Control in a Sheetmaking Machine," which are all assigned to the common assignee of the instant application.

In the manufacture of paper on continuous papermaking machines, a web of paper is formed from an aqueous suspension of fibers (wet stock) on a traveling mesh wire or fabric and water drains by gravity and vacuum suction through the fabric. The web is then transferred to the pressing section where more water is removed by dry felt and pressure. The web next enters the dryer section where steam heated dryers and hot air completes the drying process. The papermaking machine is essentially a de-watering, i.e., water removal, system. In the sheetmaking art, the term machine direction (MD) refers to the direction that the sheet material travels during the manufacturing process, while the term cross direction (CD) refers to the direction across the width of the sheet which is perpendicular to the machine direction.

Conventional methods for controlling the quality, e.g., basis weight, of the paper produced include regulating the paper stock, e.g., chemical composition and/or quantity, at the wet end of the papermaking machine. For example, the thickness of the paper at the dry end can be monitored to control the flow rate of wet stock that goes through valves of a headbox and onto the mesh wire.

In order to precisely measure some of the paper's characteristics, it is essential that the fast moving web of paper be stabilized at the point of measurement to present a consistent, flat profile since the accuracy of many measurement techniques requires that the web stay within certain limits of flatness, height variation and flutter. Moreover, to avoid paper degradation, stabilization must be accomplished without contact to the stabilizing device. This is critical at the high speeds which web material such as paper is manufactured.

Current non-contact sheet stabilizers fall into two general categories on the basis of their characteristic operation. The first category includes various air clamps that use only airflow to impart some degree of suction on the web material to urge the web material against a flat surface of the device. These air clamps have a tendency to leave marks or otherwise damage the moving web. The second category includes air clamps that use airflow to impart suction but that also generate an air bearing between a surface on the device and the web material. The latter category of stabilizers is exemplified by Vortex, Coanda and Bernoulli-type air clamps which cushion the moving web material with an air bearing as the web travels over the device. Vortex-type air clamps provide adequate air bearing support but create a "sombrero-type" profile on the web material in the center of its effective region, thus they do not generate a sufficiently flat profile. Bernoulli-type air clamps, which blow air out of recessed openings horizontally over a surface, cause the web material to contact the surface and flutter. Finally, simple Coanda slot-type air clamps provide an air bearing and a flat profile adjacent the Coanda slot but lack the ability of retaining sufficient sheet flatness along the flow direction away from the Coanda slot. The Coanda effect is a phenomenon whereby a high velocity jet of liquid issuing from a narrow slot will adhere to a surface it is traversing and will follow the contour of the surface.

As is apparent, the art is in need of a non-contact air clamp stabilizer for fast moving web materials that is able to present a flat profile of the web for analysis and that is robust in response to changes in web (machine) speed and/or weight.

SUMMARY OF THE INVENTION

The present invention is directed to an air clamp stabilizer having an operative surface that defines a Coanda slot and a "backstep" that is located downstream of the direction of the airflow that extends from the Coanda slot. This novel configuration, among other things, permits the Coanda jet to expand and to create an additional suction force. Under certain circumstances, a vortex is also generated which further contributes to the suction force. The result is that a defined area of web material rides on an air bearing as the web passes over the air clamp surface. This area of the web remains flat and is parallel to the air clamp surface.

In one embodiment, the invention is directed to a device for non-contact support of a continuous web that is moving in a downstream direction that includes:

(a) a body having an operative surface facing the web wherein the operative surface has an upper portion and a lower portion that is downstream from the upper portion and wherein the body defines a slot that is in fluid communication with a source of gas and that has an opening at the upper surface, and wherein the slot has a curved convex surface at the opening on its downstream side; and (b) means for directing a gas from the gas source through the slot so that a jet of gas moves through the opening and toward the lower portion whereby a low pressure field is established as the gas passes from the upper portion to the lower portion thereby maintaining a portion of the moving web at a substantially fixed distance to the operative surface.

In another embodiment, the invention is directed to a method of maintaining a continuous web that is moving in a downstream direction and in a prescribed orientation relative to a reference position that includes the steps of:

(a) positioning a web stabilizer below the moving web wherein the stabilizer comprises body having an operative surface facing the web wherein the operative surface has an upper portion and a lower portion that is downstream from the upper portion and wherein the body defines a slot that is in fluid communication with a source of gas and that has an opening at the upper surface, and wherein the slot has a curved convex surface at the opening on its downstream side; and (b) directing a gas from the gas source through the slot so that a jet of gas moves through the opening and toward the lower portion whereby a low pressure field is established as the gas passes from the upper portion to the lower portion thereby maintaining a portion of the moving web at a substantially fixed distance to the operative surface.

It has been demonstrated that the stabilization or flatness of the web material profile is independent of the web material speed over a broad range. The inventive stabilizer can be employed to manipulate the web material into a non-contacting relatively flat profile where measurements of the web materials characteristics can be taken with various contact-free measurements techniques.

DESCRIPTION OF THE PREFERRED EMBODIMENTS

Figure 1:
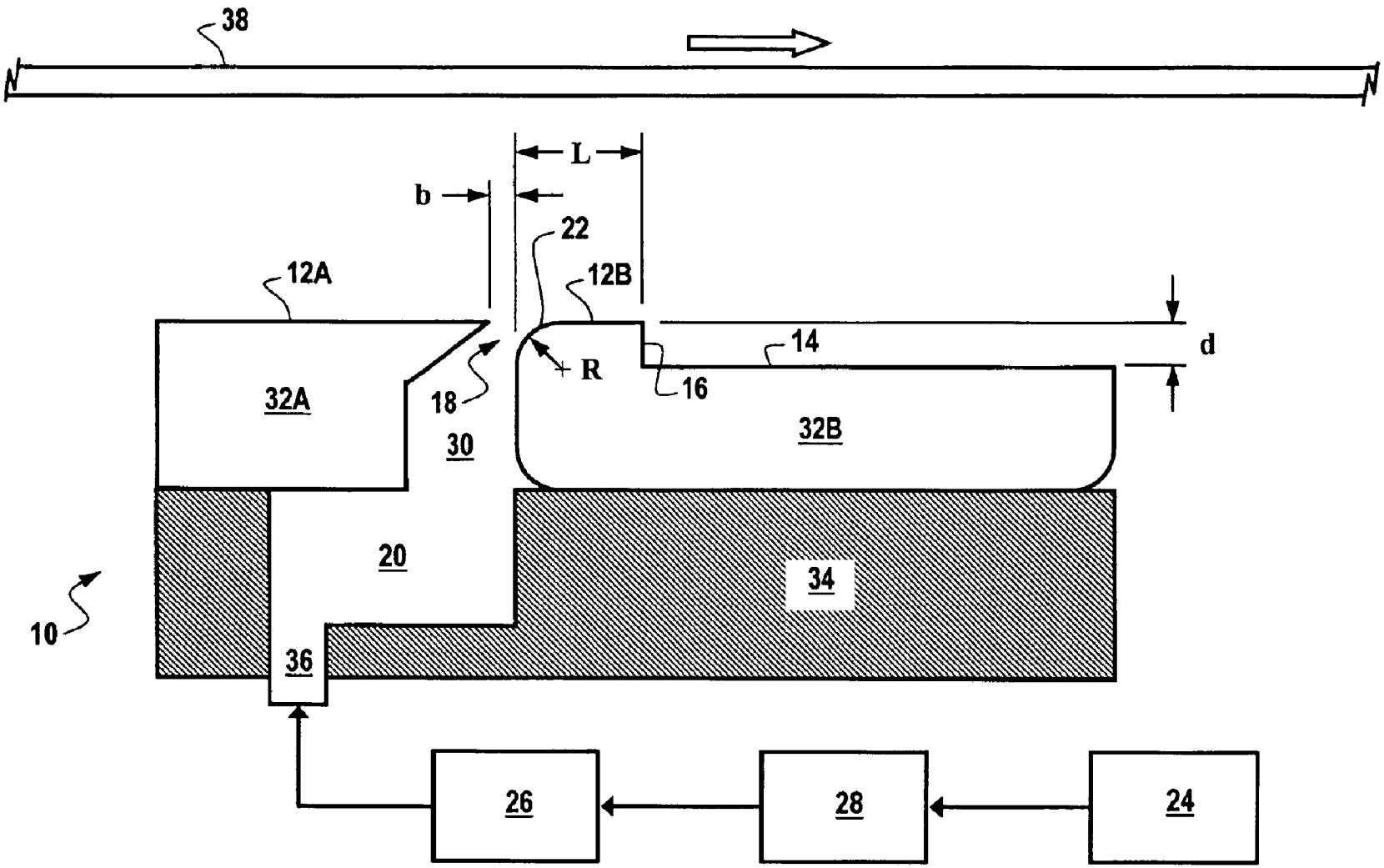
FIG. 1 is a cross sectional view of one embodiment of the air clamp stabilizer.

An embodiment of the air clamp stabilizer 10, as shown in FIG. 1, includes a body having an operative surface that is segmented into upstream upper surface 12A and downstream upper surface 12B and a lower surface 14. Upper surfaces 12A and 12B are separated by a Coanda slot 18. Upper surface 12B is disposed above lower surface 14 so that wall or backstep 16 is perpendicular with respect to both upper surface 12B and lower surface 14 which are typically coplanar. The stabilizer is positioned underneath a web of material 38 which is moving from left to right relative to the stabilizer; this direction is referred to as the downstream direction and the opposite direction is the upstream direction.

As will be further described herein, a web that is being supported by the stabilizer will exhibit a substantially planar profile at a location above lower surface 14 and downstream from backstep 16. Preferably an instrument for measuring particular properties of the web is positioned so that its sensor will make the measurements at this location. To correctly position the sensor, lower surface 14 immediately below this location can be made of an optically reflective material, such as polished ceramics. In this fashion, the position of the sensor can be appropriately adjusted, if necessary, before operations with the moving web. It is understood, however, that the instrument can be positioned anywhere above the operative surface of the stabilizer or downstream or upstream thereof, as desired.

The term "backstep" is meant to encompass a depression on the stabilizer surface located a distance downstream from Coanda slot 18 preferably sufficient to create a vortex. As demonstrated herein, the combination of the Coanda slot and backstep generates an amplified suction force and an extensive air bearing. Specifically, backstep 16 allows a Coanda jet to expand and create an additional suction force. It should be noted that jet expansion is necessary to create the suction force but vortex formation is not a prerequisite. Indeed, vortex formation does not always occur downstream from the backstep and is not necessary for operation of the air clamp stabilizer. The stabilizer's suction force initially draws the web closer to the stabilizer as the web approaches the stabilizer. Subsequently, the air bearing supports and reshapes the web so that the web exhibits a relatively flat profile as it passes over the backstep. While backstep 16 is most preferably configured as a 90 degrees vertical wall as shown in FIG. 1, the backstep can exhibit a more gradual contour so that the upper and lower surfaces can be joined by a smooth, concavely curved surface.

The body of the stabilizer also includes chamber 30 that has an opening or Coanda slot 18 between upper surfaces 12A and 12B. Coanda slot 18 has a curved surface 22 on its downstream side. Preferably this surface has a radius of curvature (R) ranging from about 1.0 mm to about 10 mm. Chamber 30 is connected to plenum chamber 20 which in turn is connected to a source of gas 24 via conduit 36. The volume of gas flowing into plenum 20 can be regulated by conventional means including flow meter 26 and pressure gauge 28. The length of chamber 30, as measured along the cross direction, preferably matches that of Coanda slot 18. Plenum 20 essentially serves as a reservoir in which high pressure gas equilibrates before being evenly distributed along the length of the Coanda slot 18 via chamber 30. Conduit 36 can include a single channel which connects the source of gas 24 to plenum 20, alternatively a plurality of holes drilled into the lower surface of the stabilizer can be employed. It is preferred that the plurality of holes be spaced apart along the cross direction of the body in order to distribute gas evenly into plenum 20.

The body of the stabilizer is preferably constructed of non-corrosive metal or hard plastic. As shown in FIG. 1, in this embodiment the body of the stabilizer includes a lower portion 34 onto which upper portions 32A, 32B are attached. Coanda slot 18 preferably traverses almost the entire width of the upper surface. Preferably, slot 18 has a width (b) of about 3 mils (76 $\mu$m) to 4 about mils (102 $\mu$m). The distance (d) from the upper to lower surfaces is preferably between about 100 $\mu$m to 1000 $\mu$m. Preferably the backstep location (L) is about 1 mm to about 10 mm from Coanda slot 18.

Any suitable gas can be employed in gas source 24 including for example, air, helium, argon, carbon dioxide. For most applications, the amount of gas employed is that which is sufficient to discharge the gas at slot 18 at a velocity of about 50 m/s to about 80 m/s. This will maintain the web at a distance ranging from about 400 $\mu$m to about 800 $\mu$m above the operative surface of the stabilizer. As is apparent, by regulating the velocity of the jet of gas exiting slot 18, one can adjust the distance that the moving web is maintained above the operative surface of the stabilizer.

As will be further demonstrated herein, a flat paper profile in the machine direction of the stabilizer can be established with the air clamp stabilizer of the present invention. It should be noted that with the air clamp stabilizer, the paper profile flatness is also maintained in the cross flow direction since the configuration of the surface of the stabilizer is symmetric in this dimension. One advantage is that the paper profile flatness can be scaled arbitrarily in the cross flow direction. Indeed, the dimensions of the air clamp stabilizer can be readily scaled to accommodate the size, weight, speed, and other variable associated with the moving web. Specifically, it will be appreciated, for instance, that the air clamp stabilizer's (i) slot width (b) (ii) curvature radius (R), (iii) depth of backstep (d), and (iv) distance of the backstep from slot (L), can be optimized systematically for a particular application and can be adapted depending on the properties, e.g., speed and weight, of the web material. Similarly, the gas jet velocity through the Coanda slot can be adjusted.

In operation, the stabilizer is positioned below a continuously moving web of material that is traveling from left to right with respect to the configuration of the stabilizer shown in FIG. 1. Gas, e.g., air, is supplied to plenum 20 and a jet of gas is forced through the Coanda slot 18 which is then deflected around curved surface 22. The curvature of the jet of air then attaches to upper surface 12B and continues parallel to upper surface 12B. The jet creates a lower pressure that generates a suction force that is normal to surface 12B and an air bearing. Backstep 16 which is located downstream of the direction of the airflow extending from Coanda slot 18 promotes the creation of additional suction forces primarily through jet expand and secondarily through vortex formation, when the latter occurs. The web material moves parallel over the stabilizer and rides on top of the air bearing.

Figure 2:
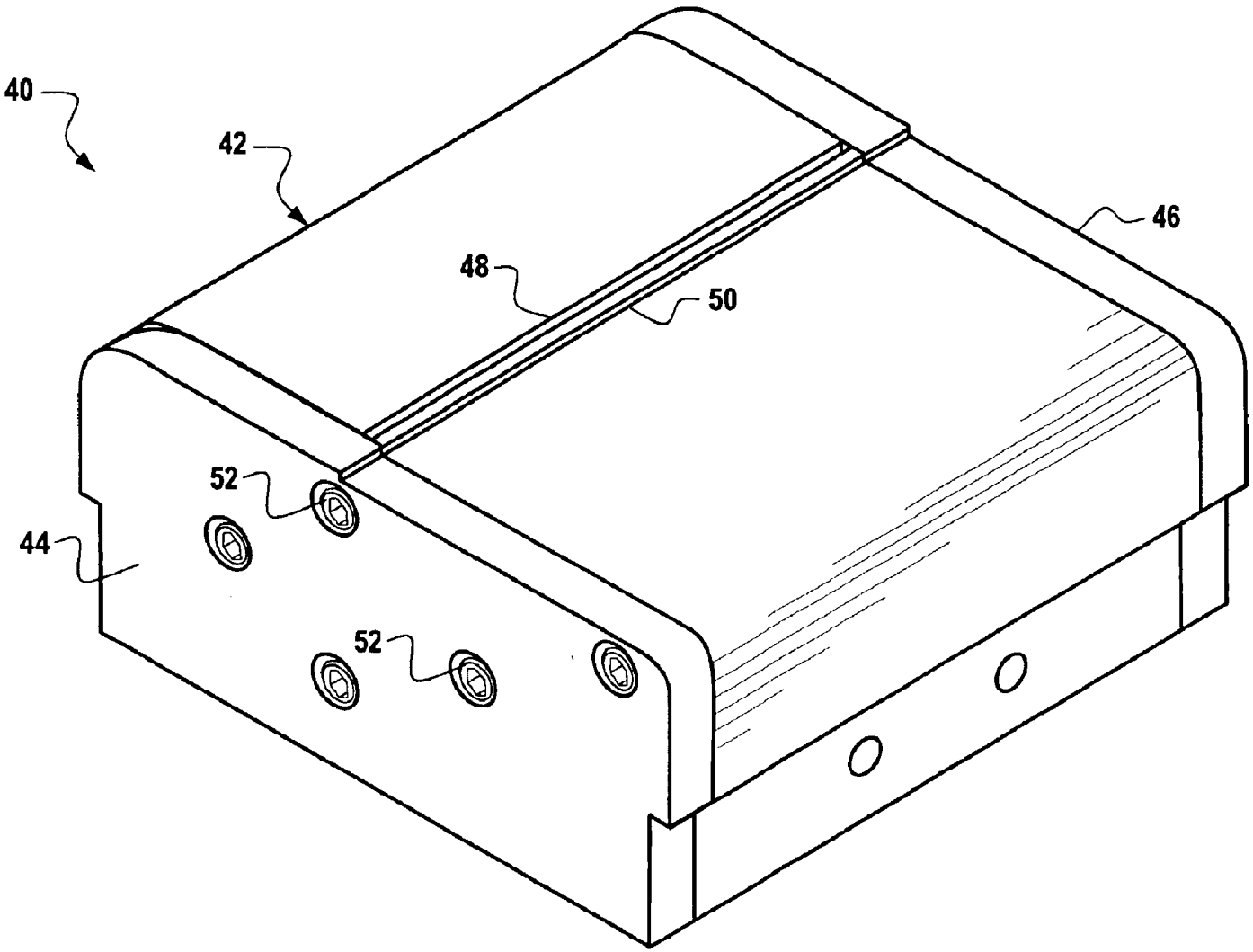
FIG. 2 is a perspective view of a second air clamp stabilizer.
Figure 3:
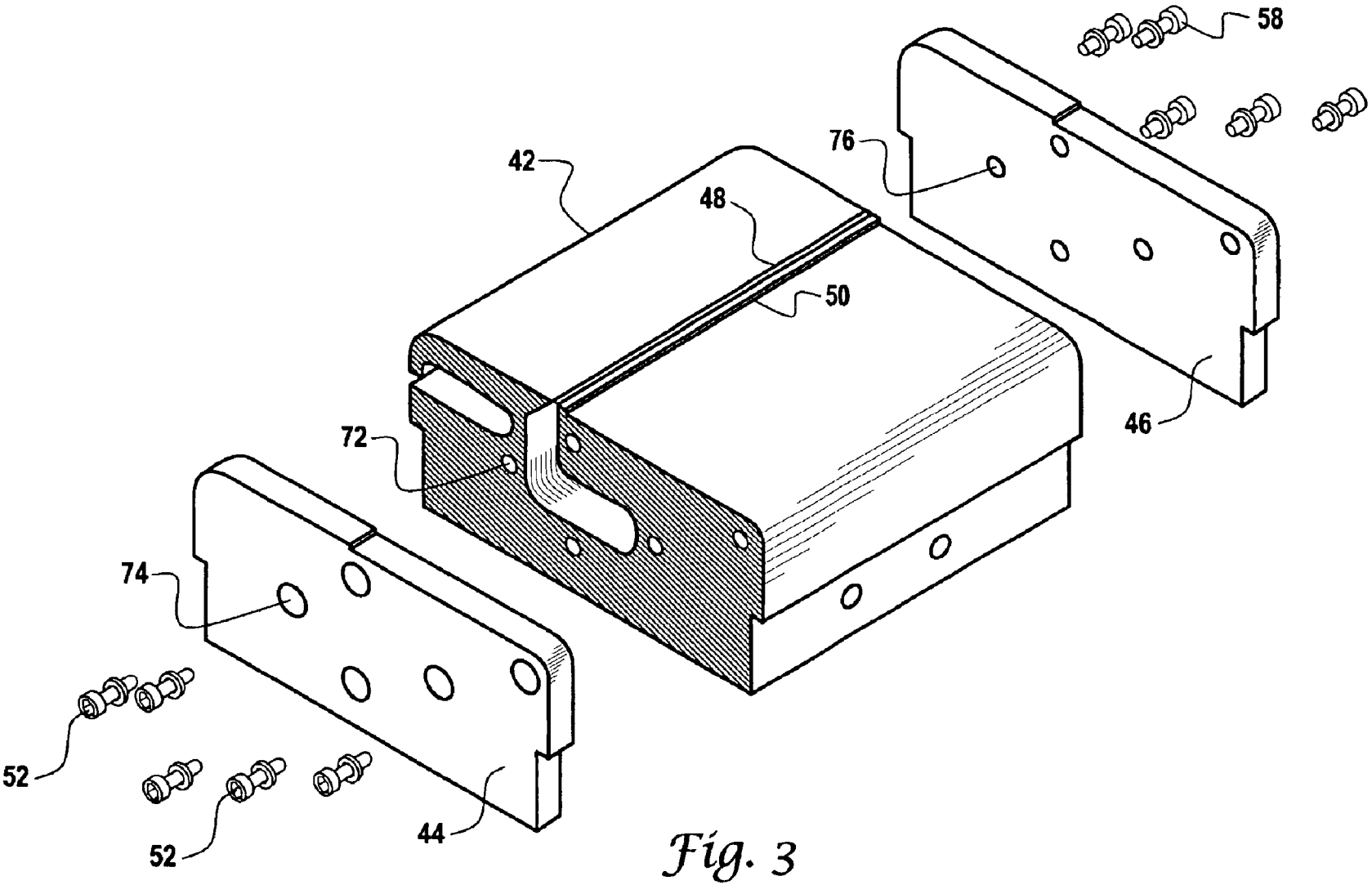
FIG. 3 is a perspective view of the second air clamp stabilizer in disassembled form.

FIGS. 2 and 3 illustrate another embodiment of the air clamp stabilizer 40 that includes a central body member 42 that is flanked by side supports 44 and 46. The central body member includes a Coanda slot 48 and accompanying backstep 50. The first side support 44 is secured to one side of the central body by screws 52 that are threaded into holes 74 and 72. Second side support 46 is similarly secured to the other side by screws 58 that are threaded holes 76 and holes on the central body (not shown). The side supports serve to seal the internal plenum and chamber as further described herein. The stabilizer is preferably constructed of stainless steel.

Figure 4:
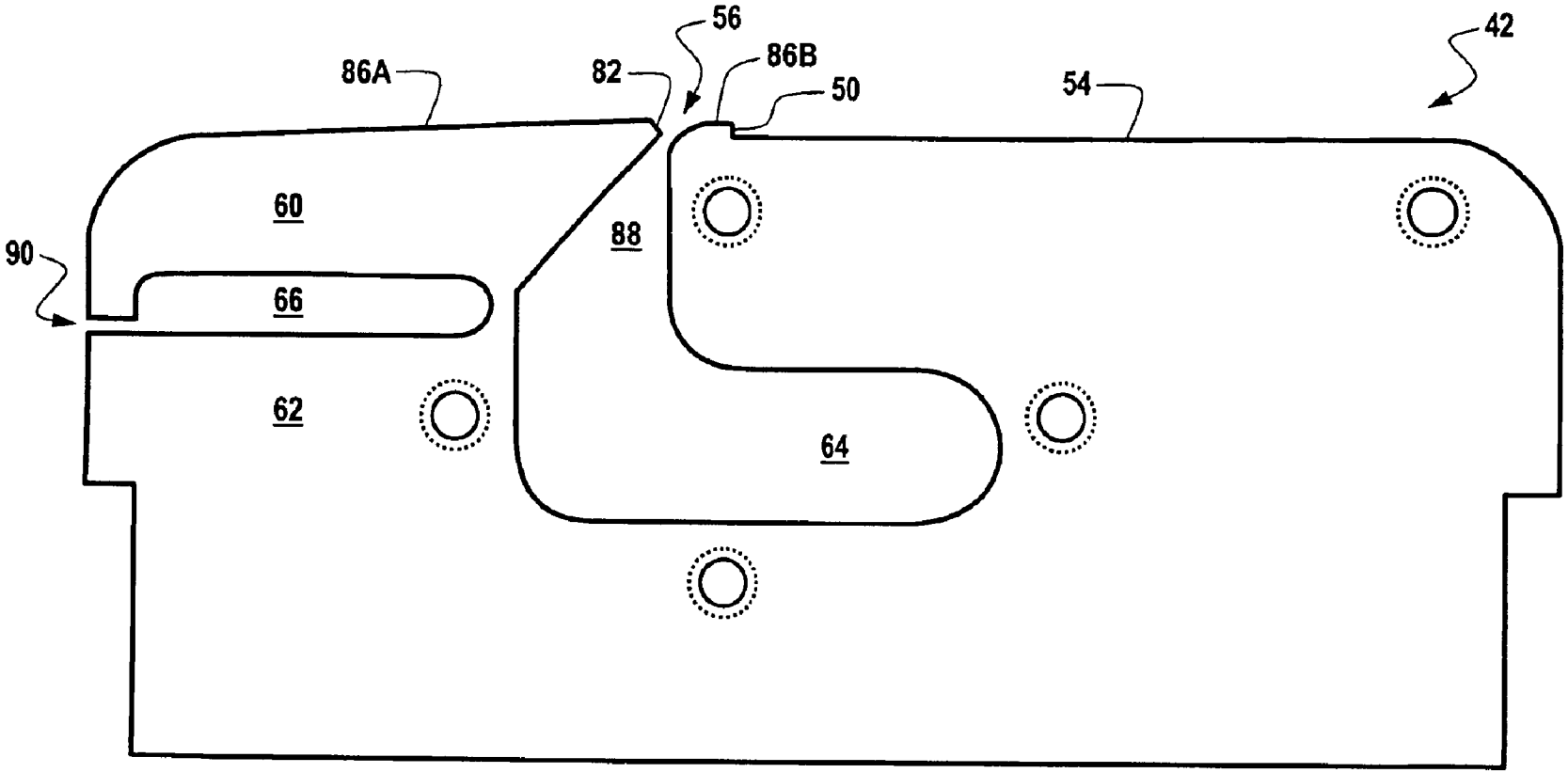
FIG. 4 is a cross-sectional view of the second air clamp stabilizer.
Figure 5:
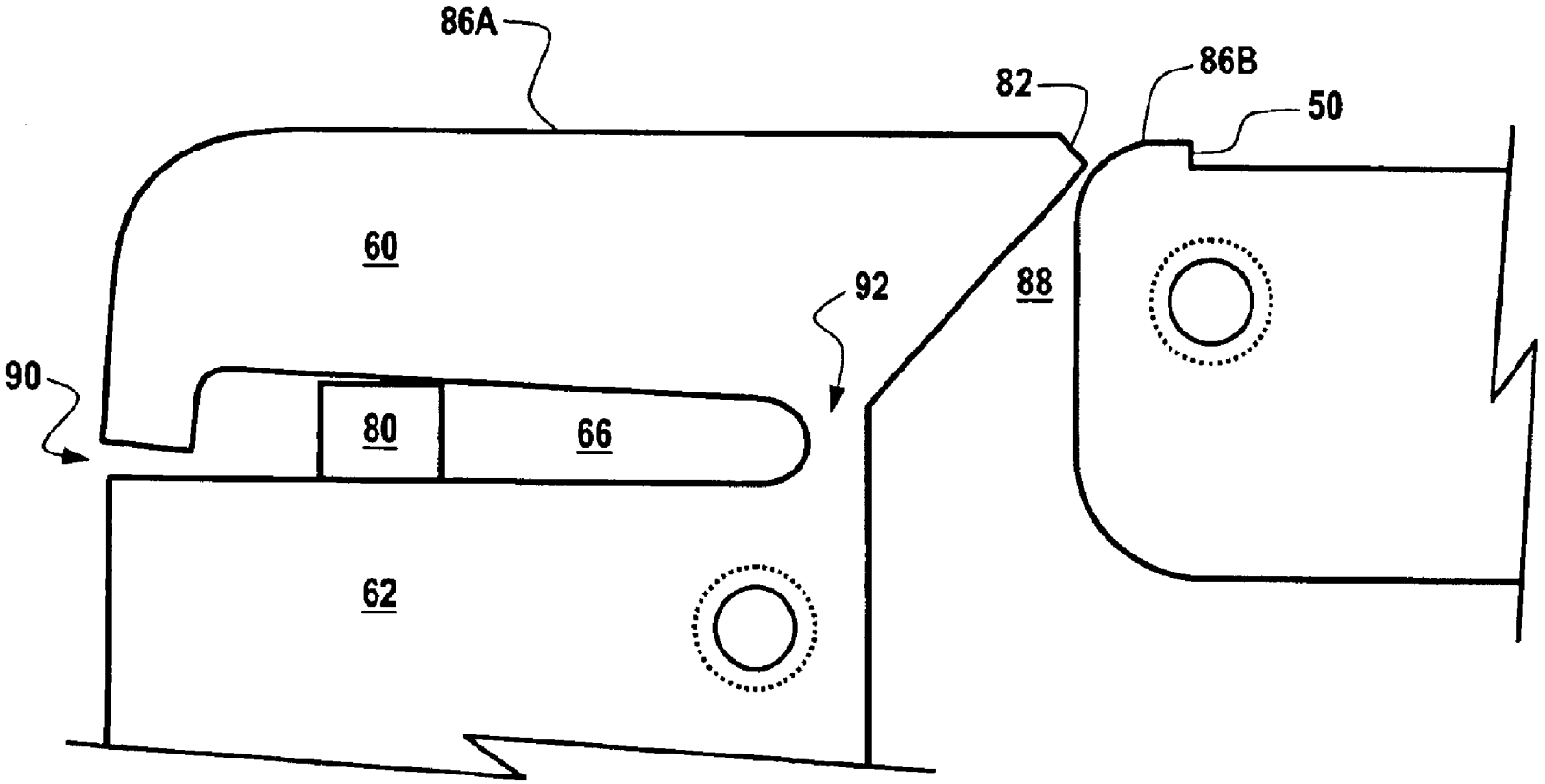
FIG. 5 is a partial cross-sectional view of the second air clamp stabilizer.

In this embodiment, the central body 42 is constructed as a single, unitary structure as illustrated in the side view of the central body shown in FIG. 4. The operative surface includes upper surfaces 86A, 86B and lower surface 54. Internally, central body 42 includes an elongated plenum 64 that is in communication with a narrower chamber 88 which has an opening that forms Coanda slot 56. As is apparent, plenum 64 and chamber 88 are not two distinct cavities within the central body rather they can represent two regions of a single cavity that traverses the width (cross direction) of the central body. A plurality of evenly spaced holes (not shown) is drilled through the underside of the central body and into plenum 64. The holes serve as gas inlets. Central body 42 further defines an elongated slot 66 under upper surface 86A that traverses the width of the central body. Slot 66 also has an opening 90 on one side thereby creating a cantilever or projecting structure 60 above slot 66 and a base 62 below slot 66. As is apparent, the size, i.e., width, of the gap of Coanda slot 56 can be adjusted by moving edge 82 towards or away from upper surface 86B. As shown in FIG. 5, a rigid object 80 when inserted into the slot 66 moves edge 82 forward to reduce the width of Coanda slot 56. (In one embodiment, a plurality of adjustable screws are employed.) The narrow region 92 between slot 66 and chamber 88 functions as a fulcrum on which cantilever structure 60 pivots.

EXAMPLE 1

A stainless steel air clamp stabilizer having the configuration shown in FIG. 1 was fabricated and tested. Specifically, the stabilizer included a Coanda slot having a width (b) of 0.1 mm (0.004 in) and a curvature radius (R) of 1.6 mm (0.0625 in). In addition, the stabilizer had a backstep location (L) 3 mm downstream of the slot and a backstep depth (d) of 0.5 mm. Gas was supplied into plenum through three holes drilled into the underside of the device. The air clamp was employed to support a moving web of newsprint that was traveling at about 1790 m/min and had a water weight of 68 grams per square meter (gsm). The term "water weight" refers to the mass or weight of water per unit area of the paper.

The contour of the stabilizer surface was measured prior to operations. As depicted by the lower curve in FIG. 6, the vertical position of the upper surface was set at 500 $\mu$m above that of the lower surface. The lower curve highlights the presence of the Coanda slot located at about position −7 mm (corresponding the first sharp decline on the lower curve) and the backstep located at about position −4. During operations the paper sheet profile was measured by scanning over the paper surface with a laser triangulation sensor as the paper sheet was moved horizontally over the surface of the air clamp stabilizer. As depicted by the upper curve of FIG. 5, the fluctuating paper was pulled a distance of about 1.5 mm toward the stabilizer surface by the suction force of the stabilizer. The air pressure supplied to the Coanda slot was 40 psi. However, when the paper reached the backstep, the paper contour becomes flat over a distance of more than 10 mm with a slope of less than 0.1 degrees over this span. Because of the air bearing, the paper did not touch the air clamp surface.

EXAMPLE 2

Figure 6:
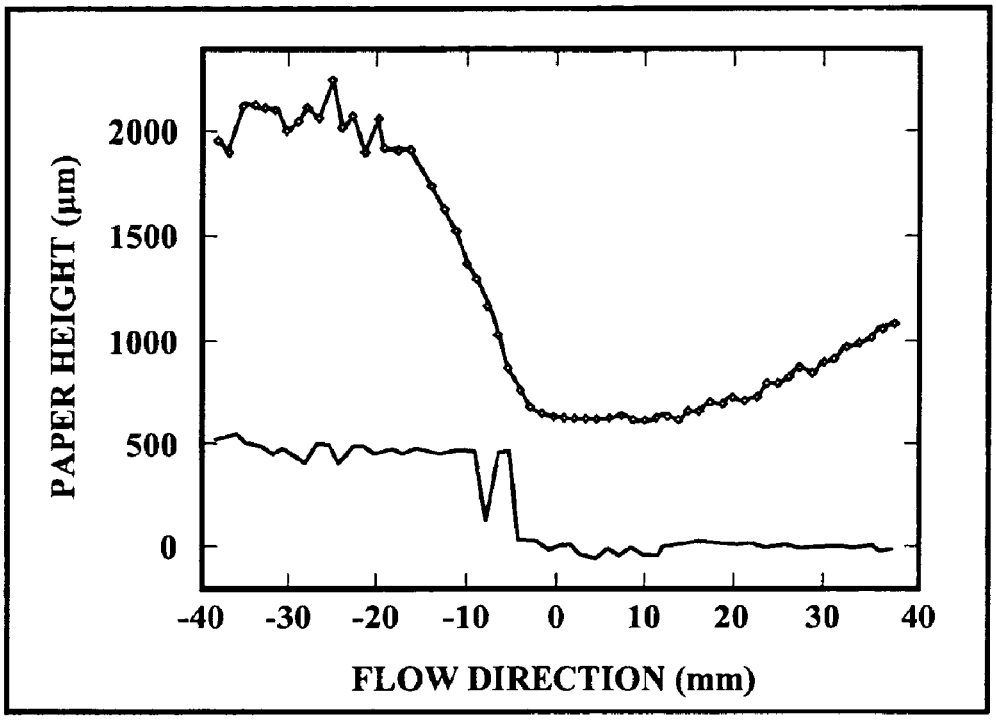
FIG. 6 is a graph of the paper profile over the Coanda slot-backstep portion of the air clamp.

To demonstrate that incorporating a backstep downstream from the Coanda slot was the cause of the of improved paper sheet flatness, another stabilizer having the same Coanda slot as the stabilizer of Example 1 but without any backstep was tested. The conditions employed were the same as those for Example 1. As shown in FIG. 6, the paper profile has a pronounced minimum close to the location of the Coanda slot (indicated by the vertical hatched line) with a sharp increase downstream. The flat area that was obtained with the backstep (as shown in FIG. 5) is missing altogether. This shows the significance of the backstep in order to achieve sheet flatness.

EXAMPLE 3

Figure 7:
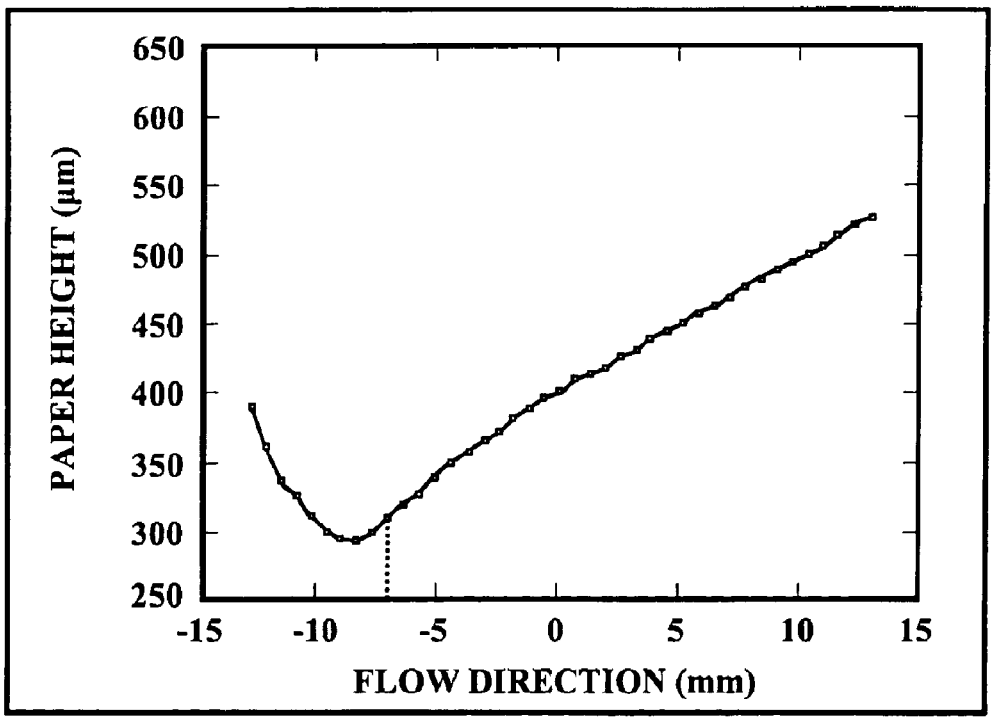
FIG. 7 is a graph of the paper profile over a simple Coanda slot without a backstep.
Figure 8:
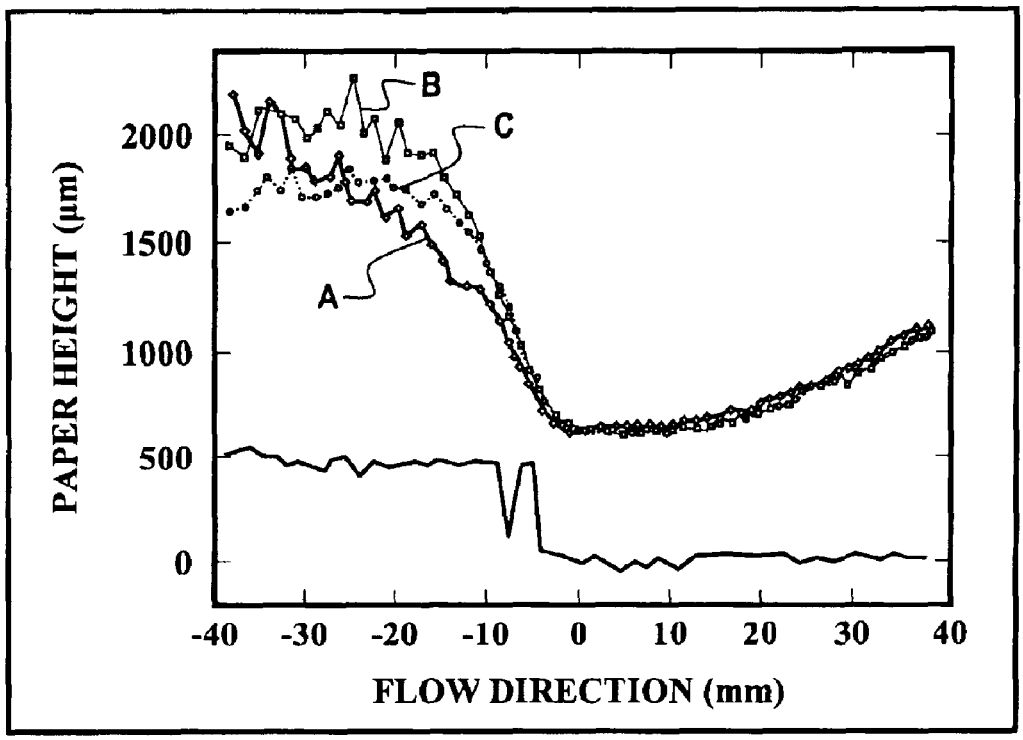
FIG. 8 is a graph of the paper profile over the Coanda slot-backstep portion of the air clamp at different paper speeds.

The behavior of the air clamp stabilizer in response to changes in web speed was also studied. The procedure of Example 1 was repeated for newsprint traveling at 800 m/min. and 2690 m/min. FIG. 7 shows the paper sheet profiles 800 (curve A), 1790 (curve B), and 2690 m/min. (curve C). As is apparent, curve B and the stabilizer surface profile are identical to those of FIG. 5. The data show that the paper sheet profile downstream of the stabilizer is basically independent of the paper speed. Again the stabilized flat areas extend over 10 mm and have slopes of less than 0.1 degrees at all three paper speeds.

EXAMPLE 4

As noted above, the optimal ranges of the geometric dimensions for the air clamp stabilizer can be ascertained experimentally or by computer simulation for different processes, e.g., web materials. As an example, experiments were conducted to observe the effects of adjusting the Coanda slot width to curvature ratio on suction pressure. The suction pressure is the suction force that is exerted on a sheet of paper placed over the stabilizer. Specifically, three stabilizers each with a different Coanda slot radius of curvature, i.e., 0.0625 in. (0.16 cm), 0.1875 in. (0.48 cm), and 0.3750 in. (0.96 cm) were tested as a function of slot width that ranged from 0.003 in. (0.0076 cm) to 0.03 in. (0.076 cm) at a constant supply air pressure for each. The pressures were selected so as to result in jet attachment to the operative surface of the stabilizer. Jet attachment is a necessary condition for a working air clamp stabilizer. For instance, if the radius of curvature is too small and/or the gap too large, the jet of gas exiting the Coanda slot would detach from the operative surface and not follow the curvature radius. Instead, the jet of gas would traject essentially vertically from the Coanda slot and actually push the paper away rather than exert a suction force thereon.

Figure 9:
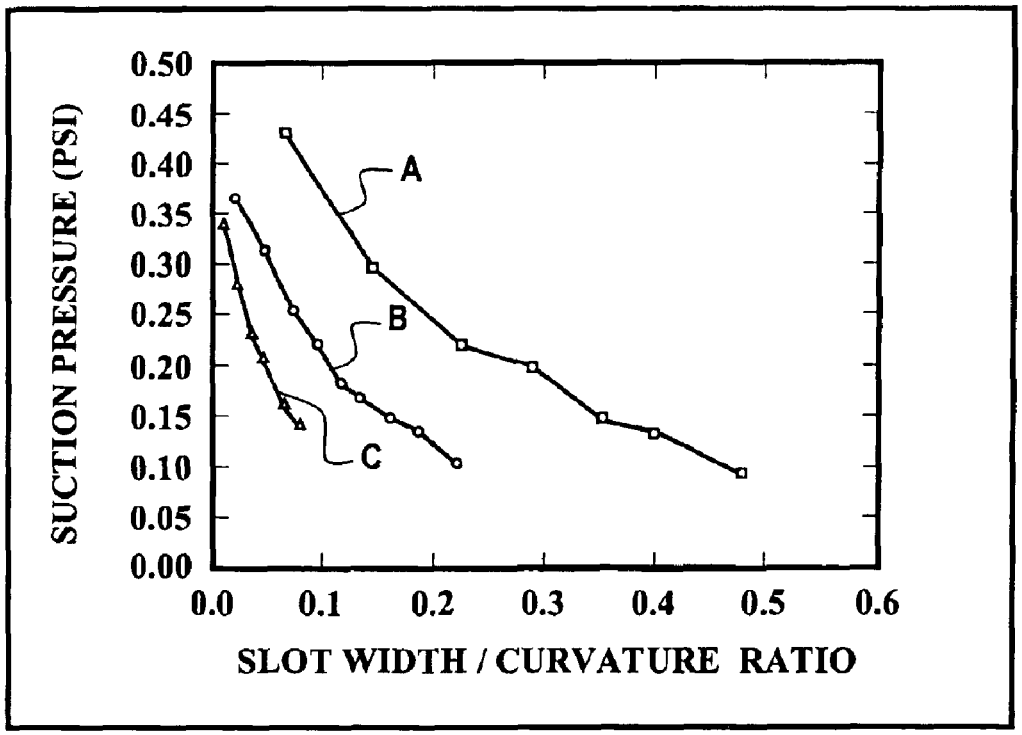
FIG. 9 is a graph of suction pressure versus slot width to curvature ratio for an air clamp stabilizer.

The results are shown in FIG. 9 with curves A, B, and C, representing the Coanda slots with curvature radii of 0.0625 in., 0.1875 in, and 0.3750 in., respectively. As is apparent, the highest suction force was achieved with stabilizers having the smallest chosen curvature and the smallest slot width. The data also suggest that the suction force was localized over a small area adjacent to the Coanda slot. For other applications where a lower suction force can be used, a larger radius with a possibly larger slot width may be selected. The resulting stabilizer will also spread the suction force over a greater area.

Web material that is supported by the inventive stabilizer is preferably subject to measurement(s) with a non-contact instrument, e.g., optical sensors. For example, the dry basis weight or thickness of paper can be measured. Suitable instruments and techniques for these procedures are described, for example, in U.S. Pat. Nos. 4,767,935 "System and Method for Measurement of Traveling Webs," U.S. Pat. No. 4,879,471 "Rapid-Scanning Infrared Sensor," and U.S. Pat. No. 6,281,679 "Web Thickness Measurement System," which are all assigned to the common assignee of the instant application and which are incorporated herein by reference. Another exemplary application is measuring properties of a web of material that has been coated. For example, optical techniques for measuring the gel point of a liquid material coated on paper is described in U.S. Pat. No. 6,191,430 "Gel Point Sensor," which is assigned to the common assignee of the instant application and which is incorporated herein by reference.

While the advantages of the air clamp stabilizer have been illustrated in association with the manufacture of paper, it is understood that the air clamp stabilizer can be employed in any environment where a moving web of material must be stabilized to establish a flat profile for measurement or simply for ease of processing, e.g., packaging, during manufacturing. For example, the stabilizer can be readily implemented in the manufacture of fabrics.

Although only preferred embodiments of the invention are specifically disclosed and described above, it will be appreciated that many modifications and variations of the present invention are possible in light of the above teachings and within the purview of the appended claims without departing from the spirit and intended scope of the invention.

What is claimed is:

1. A device for non-contact support of a continuous web that is moving in a downstream direction that comprises:

(a) a body having an operative surface facing the web wherein the operative surface has an upper portion and a lower portion that is downstream from the upper portion and wherein the body defines a slot that is in fluid communication with a source of gas and that has an opening at the upper surface, and wherein the slot has a curved convex surface at the opening on its downstream side and wherein the upper portion is vertically spaced from the lower portion and wherein the vertical distance between the upper portion to the lower portion is about 100 $\mu$m to about 1000 $\mu$m; and (b) means for directing a gas from the gas source through the slot so that a jet of gas moves through the opening and toward the lower portion whereby a low pressure field is established as the gas passes from the upper portion to the lower portion thereby maintaining a portion of the moving web at a substantially fixed distance to the operative surface.

2. The device of claim 1 wherein the upper portion and the lower portion are parallel to each other and a surface connecting the upper portion to the lower portion defines a plane that is perpendicular to the upper portion and lower portion.

3. The device of claim 1 wherein a surface connecting the upper portion and the lower portion is a concavely curved surface.

4. The device of claim 1 wherein the body defines a plenum and the means for directing the gas comprises a pump that pumps gas through the plenum and into the slot.

5. The device of claim 1 wherein the gas discharged from the slot at a velocity of about 50 m/s to about 80 m/s.

6. The device of claim 1 wherein the gas is air.

7. The device of claim 1 wherein the web comprises paper.

8. A method of maintaining a continuous web that is moving in a downstream direction and in a prescribed orientation relative to a reference position that comprises the steps of:

(a) positioning a web stabilizer below the moving web wherein the stabilizer comprises body having an operative surface facing the web wherein the operative surface has an upper portion and a lower portion that is downstream from the upper portion and wherein the body defines a slot that is in fluid communication with a source of gas and that has an opening at the upper surface, and wherein the slot has a curved convex surface at the opening on its downstream side wherein the upper portion is vertically spaced from the lower portion and wherein the vertical distance between the upper portion to the lower portion is about 100 $\mu$m to about 1000 $\mu$m; and (b) directing a gas from the gas source through the slot so that a jet of gas moves through the opening and toward the lower portion whereby a low pressure field is established as the gas passes from the upper portion to the lower portion thereby maintaining a portion of the moving web at a substantially fixed distance to the operative surface.

9. The method of claim 8 wherein the upper portion and the lower portion are parallel to each other and a surface connecting the upper portion to the lower portion defines a plane that is perpendicular to the upper portion and lower portion.

10. The method of claim 8 wherein a surface connecting the upper portion and the lower portion is a concavely curved surface.

11. The method of claim 8 wherein the body defines a plenum and the means for directing the gas comprises a pump that pumps gas through the plenum and into the slot.

12. The method of claim 8 wherein the gas discharged from the slot at a velocity of about 50 m/s to about 80 m/s.

13. The method of claim 8 wherein the gas is air.

14. The method of claim 8 wherein the curved convex surface has a radius of curvature of about 1.6 mm to about 10 mm.

15. The method of claim 8 wherein the web comprises paper.

16. The method of claim 8 wherein the moving web is maintained as a flat profile in both a machine direction and a cross direction.

17. A device for non-contact support of a continuous web that is moving in a downstream direction that comprises:

(a) a body having an operative surface facing the web wherein the operative surface has an upper portion and a lower portion that is downstream from the upper portion and wherein the body defines a slot that is in fluid communication with a source of gas and that has an opening at the upper surface, and wherein the slot has a curved convex surface at the opening on its downstream side and wherein the slot comprises an elongated opening with a length that is transverse to the direction of the moving web wherein the opening separates the upper portion of the body into an upstream portion and a downstream portion, and wherein the upstream portion is pivotally attached to the body to permit adjustment of the width of the opening;

(b) means for directing a gas from the gas source through the slot so that a jet of gas moves through the opening and toward the lower portion whereby a low pressure field is established as the gas passes from the upper portion to the lower portion thereby maintaining a portion of the moving web at a substantially fixed distance to the operative surface; and (c) means for adjusting the width of the opening.

18. A device for non-contact support of a continuous web that is moving in a downstream direction that comprises:

(a) a body having an operative surface facing the web wherein the operative surface has an upper portion and a lower portion that is downstream from the upper portion and wherein the body defines a slot that is in fluid communication with a source of gas and that has an opening at the upper surface, and wherein the slot has a curved convex surface at the opening on its downstream side and wherein the slot comprises an elongated opening with a length that is transverse to the direction of the moving web and wherein the opening has a width of about 75 $\mu$m to 100 about $\mu$m; and (b) means for directing a gas from the gas source through the slot so that a jet of gas moves through the opening and toward the lower portion whereby a low pressure field is established as the gas passes from the upper portion to the lower portion thereby maintaining a portion of the moving web at a substantially fixed distance to the operative surface.

19. A method of maintaining a continuous web that is moving in a downstream direction and in a prescribed orientation relative to a reference position that comprises the steps of:

(a) positioning a web stabilizer below the moving web wherein the stabilizer comprises body having an operative surface facing the web wherein the operative surface has an upper portion and a lower portion that is downstream from the upper portion and wherein the body defines a slot that is in fluid communication with a source of gas and that has an opening at the upper surface, and wherein the slot has a curved convex surface at the opening on its downstream side, wherein the slot comprises an elongated opening with a length that is transverse to the direction of the moving web and wherein the opening separates the upper portion of the body into an upstream portion and a downstream portion, and wherein the upstream portion is pivotally attached to the body to permit adjustment of the width of the opening, and wherein the body includes means for adjusting the width of the opening; and (b) directing a gas from the gas source through the slot so that a jet of gas moves through the opening and toward the lower portion whereby a low pressure field is established as the gas passes from the upper portion to the lower portion thereby maintaining a portion of the moving web at a substantially fixed distance to the operative surface.

20. A method of maintaining a continuous web that is moving in a downstream direction and in a prescribed orientation relative to a reference position that comprises the steps of:

(a) positioning a web stabilizer below the moving web wherein the stabilizer comprises body having an operative surface facing the web wherein the operative surface has an upper portion and a lower portion that is downstream from the upper portion and wherein the body defines a slot that is in fluid communication with a source of gas and that has an opening at the upper surface, and wherein the slot has a curved convex surface at the opening on its downstream side, wherein the slot comprises an elongated opening with a length that is transverse to the direction of the moving web and wherein the opening has a width of about 75 $\mu$m to 100 about $\mu$m; and (b) directing a gas from the gas source through the slot so that a jet of gas moves through the opening and toward the lower portion whereby a low pressure field is established as the gas passes from the upper portion to the lower portion thereby maintaining a portion of the moving web at a substantially fixed distance to the operative surface.

21. A method of maintaining a continuous web that is moving in a downstream direction and in a prescribed orientation relative to a reference position that comprises the steps of:

(a) positioning a web stabilizer below the moving web wherein the stabilizer comprises body having an operative surface facing the web wherein the operative surface has an upper portion and a lower portion that is downstream from the upper portion and wherein the body defines a slot that is in fluid communication with a source of gas and that has an opening at the upper surface, and wherein the slot has a curved convex surface at the opening on its downstream side; and (b) directing a gas from the gas source through the slot so that a jet of gas moves through the opening and toward the lower portion whereby a low pressure field is established as the gas passes from the upper portion to the lower portion thereby maintaining a portion of the moving web at a substantially fixed distance to the operative surface and wherein at least a portion of the moving web is maintained at a distance of about 400 $\mu$m to about 800 $\mu$m above the surface of the body.

22. A method of maintaining a continuous web that is moving in a downstream direction and in a prescribed orientation relative to a reference position that comprises the steps of:

(a) positioning a web stabilizer below the moving web wherein the stabilizer comprises body having an operative surface facing the web wherein the operative surface has an upper portion and a lower portion that is downstream from the upper portion and wherein the body defines a slot that is in fluid communication with a source of gas and that has an opening at the upper surface, and wherein the slot has a curved convex surface at the opening on its downstream side; and (b) directing a gas from the gas source through the slot so that a jet of gas moves through the opening and toward the lower portion whereby a low pressure field is established as the gas passes from the upper portion to the lower portion thereby maintaining a portion of the moving web at a substantially fixed distance to the operative surface and wherein the web is moving at a speed of about 800 m/min to about 2700 m/min.

* * * * *